US008863770B2

(12) United States Patent
Markvart et al.

(10) Patent No.: US 8,863,770 B2
(45) Date of Patent: Oct. 21, 2014

(54) FLOW ADJUSTMENT VALVE

(75) Inventors: Arne Markvart, Silkeborg (DK); Bent Karsten Rasmussen, Silkeborg (DK); Morten Christensen, Auning (DK); Jens Pagh Schmidt, Herning (DK); Claus Fisker, Skanderborg (DK); Lars Therkelsen, Beder (DK)

(73) Assignee: Danfoss A/S, Nordborg (DK)

( * ) Notice: Subject to any disclaimer, the term of this patent is extended or adjusted under 35 U.S.C. 154(b) by 977 days.

(21) Appl. No.: 12/444,729

(22) PCT Filed: Oct. 5, 2007

(86) PCT No.: PCT/DK2007/000435

§ 371 (c)(1),
(2), (4) Date: Jun. 30, 2009

(87) PCT Pub. No.: WO2008/043363

PCT Pub. Date: Apr. 17, 2008

(65) Prior Publication Data

US 2010/0000616 A1 Jan. 7, 2010

(30) Foreign Application Priority Data

Oct. 10, 2006 (DE) ..... 10 2006 047 880

(51) Int. Cl.
*F16K 37/00* (2006.01)
*F24D 19/10* (2006.01)

(52) U.S. Cl.
CPC ..... *F24D 19/1015* (2013.01); *F24D 19/1036* (2013.01)
USPC ..... 137/557

(58) Field of Classification Search
USPC ..... 137/557, 614.16, 614.17, 614.18; 251/315.12
See application file for complete search history.

(56) References Cited

U.S. PATENT DOCUMENTS 4,138,087 A 2/1979 Kruse et al.
5,203,370 A * 4/1993 Block et al. ..... 137/312

(Continued)

FOREIGN PATENT DOCUMENTS

| | | | |
|---|---|---|---|
| DE | 3539463 | A1 | 5/1987 |
| DE | 3816880 | A1 | 11/1989 |
| DE | 4030104 | A1 | 10/1996 |
| DE | 19619125 | A1 | 5/1997 |
| EP | 0153427 | A1 | 7/1987 |
| EP | 1676990 | A1 | 7/2006 |

OTHER PUBLICATIONS

International Search Report for PCT/DK2007/000435 dated Jan. 23, 2008.

*Primary Examiner* — John K Fristoe, Jr.
*Assistant Examiner* — Kevin E Lynn
(74) *Attorney, Agent, or Firm* — McCormick, Paulding & Huber LLP

(57) ABSTRACT

The invention relates to a flow adjustment valve (1) comprising a valve housing (2) having a flow channel (3) and a pipe stub (10), disposed at an angle to the flow channel (3). A throttle unit (6) is arranged in the flow channel (3) and comprises a throttle element (8) that can be actuated through the pipe stub (10). The flow adjustment valve also comprises two measuring points (14, 15) for detecting the pressure in the flow channel (3) at both sides of a throttle arrangement, each of which measuring points being connected to a pressure measuring connection (17) via a pressure measuring channel (26, 27). The aim of the invention is to improve the design options for a flow adjustment valve of the aforementioned type. For this purpose, at least one pressure measuring channel (26) is guided through the pipe stub (10).

14 Claims, 1 Drawing Sheet

(56) References Cited

U.S. PATENT DOCUMENTS 5,261,437 A * 11/1993 Kalix ..... 137/1
5,566,711 A * 10/1996 Glansk et al. ..... 137/557
5,669,414 A * 9/1997 Miller ..... 137/557
5,673,919 A * 10/1997 Muller ..... 277/320
6,050,296 A 4/2000 Hoffman et al.
7,415,346 B2 8/2008 Musashi et al.
2006/0174701 A1 * 8/2006 Musashi et al. ..... 73/118.1

* cited by examiner

FLOW ADJUSTMENT VALVE

CROSS REFERENCE TO RELATED APPLICATION

This application is entitled to the benefit of and incorporates by reference essential subject matter disclosed in International Patent Application No. PCT/DK2007/000435 filed on Oct. 5, 2007 and German Patent Application No. 10 2006 047 880.0 filed Oct. 10, 2006.

FIELD OF THE INVENTION

The invention concerns a flow adjustment valve having a valve housing comprising a flow channel and a pipe stub arranged at an angle to the flow channel, a throttle unit being arranged in the flow channel, said throttle unit having a throttle element being activatable through the pipe stub, and having on either side of a throttle arrangement a measuring spot for measuring the pressure in the flow channel, each measuring spot being connected to a pressure measuring connection via a pressure measuring channel.

BACKGROUND OF THE INVENTION

Such a flow adjustment valve is, for example, known from DE 196 19 125 C2. Here, the throttle arrangement is formed by a measuring jack, which is arranged ahead of the throttle unit. The pressure measuring channels branching off on each side of this measuring jack are led out laterally, so that the pressure measuring connections are located in lateral faces of the valve housing and have an angle in relation to the pipe stub of approximately 45° and an angle in relation to each other of 90°.

Such a flow adjustment valve serves the purpose of hydraulically balancing a hydraulic system, for example a pump operated hot water heating. The balancing is meant to cause that the flow amounts in different sections of the fluid-filled systems correspond to certain specifications.

For this purpose, the pressure on both sides of the throttle arrangement is measured. If the size of the throttle arrangement is known, the flow can be calculated on the basis of the pressure. The flow can be changed by means of the throttle unit. It is also known to use the throttle unit as throttle arrangement. In this case, a scale or another display device is needed, from which the actual opening degree of the throttle unit can be seen.

Independently of that, it is necessary to have the opportunity of measuring the pressure on both sides of the throttle arrangement and thus the pressure difference over the throttle arrangement.

Such a flow adjustment valve is only seldomly activated, usually at the start up of such a hydraulic system or after changes of the hydraulic system. In order to ensure that it does not otherwise interfere, it is often mounted in an inaccessible spot, for example under floors or in ducts. This, however, makes the setting of the flow difficult for an installer, as the flow adjustment valve is difficult to access. Particularly, it is often difficult to insert measuring probes in the pressure measuring connections. This will in many cases require the installer to have a substantial amount of skill.

BRIEF SUMMARY OF THE INVENTION

The invention is based on the task of expanding the configuration opportunities of the flow adjustment valve.

With a flow adjustment valve as mentioned in the introduction, this task is solved in that at least one pressure measuring channel is led through the pipe stub.

This gives further opportunities of positioning the pressure measuring connection. It is no longer required to arrange the pressure measuring connection immediately next to the opening of the pressure measuring channel into the flow channel. On the contrary, the pressure measuring connection can now also be arranged in the area of the pipe stub, where it can more easily be accessed by an installer. Here, the term "pipe stub" covers all parts extending from the valve housing under the initially mentioned angle to the flow channel. In this connection, the pipe stub can completely or partly be a part of the valve housing. It is also possible to use a separate element as pipe stub, said element being connected to the valve housing. The pipe stub can also be made of several parts, which can be assembled in the axial and/or the radial direction (related to the pipe stub) or in the circumferential direction.

Preferably, an insert is arranged in the pipe stub, and at least a part of the length of the pressure measuring channel is formed between the insert and a pipe stub wall. A working of the pipe stub itself is often no longer required, apart from an opening, which will under certain circumstances penetrate the pipe stub wall to permit the pressure to be led to the outside.

It is preferred that the insert carries the throttle element. The insert is thus made for two purposes, namely to form the pressure measuring channel and to hold the throttle element.

Preferably, each pressure measuring connection is placed in a measuring pipe stub, and both measuring pipe stubs extend in parallel to one another. This simplifies the placing or insertion of pressure measuring sensors, as both pressure measuring sensors can be moved at the same time to be inserted in the measuring pipe stubs. Thus, it is possible to connect the pressure measuring sensors mechanically to each other, for example to arrange them on a common holder, so that the time required to place the pressure measuring sensors is practically halved.

Preferably, the measuring pipe stubs enclose an angle in the range of 20° to 70° with the pipe stub. Thus, the measuring pipe stubs can be arranged in the area between the pipe stub and the housing, surrounding the flow channel in this area. As the installer must anyway have access to the pipe stub to activate the throttle element, it must be assumed that in this area also the pressure measuring connections are accessible for the insertion of a measuring probe.

Preferably, the measuring pipe stubs are aligned in a knuckle between the pipe stub and a longitudinal section of the valve housing surrounding the flow channel. Thus, from the outside a very compact design of the flow adjustment valve is maintained. All elements projecting laterally from the valve housing thus, in a manner of speaking, originate from one point. This also keeps the risk small that someone gets stuck at the measuring pipe stub.

Preferably, at least a part of the length of the pipe stub is arranged between the two pressure measuring channels. Thus, the pipe stub is also used to separate the two pressure measuring channels from one another. Further components are not required for this purpose. This simplifies the design of the valve housing.

Preferably, at least one pressure measuring connection is arranged in a connection element that is rotatably held at the pipe stub. Thus, it is possible to rotate the pressure measuring connection in relation to the pipe stub and bring it to a position, which is favourable for placing a pressure measuring probe. This further facilitates the handling.

Preferably, the connection element has the form of a sleeve, which surrounds the pipe stub. Thus, the sleeve forms some kind of sleeve that surrounds the pipe stub annularly. Then, the pipe stub forms a pivot bearing for the sleeve, so that a design occurs that is relatively resistant to mechanical loads.

Preferably, an annular channel is formed between the sleeve and the pipe stub. The annular channel forms a part of the pressure measuring channel. The annular channel can ensure that the pressurised fluid can always reach the pressure measuring connection, independently of the rotary position of the sleeve in relation to the pipe stub.

Preferably, an annular channel is formed between the sleeve and the valve housing in the area of a front face of the sleeve. This annular channel, in a manner of speaking the second annular channel, then forms a part of the pressure measuring channel from the second pressure measuring connection. The two pressure measuring channels can be clearly separated from each other, namely one at the front side of the sleeve and one in the area of the axial length of the sleeve. This simplifies the embodiment.

Preferably, the annular channel is bordered by an outer wall of the sleeve. The second annular channel is thus located in a knuckle between the pipe stub and the remaining part of the valve housing, so that these two elements do already form two bordering walls of the annular channel. The remaining border of the annular channel is formed by the sleeve itself.

BRIEF SUMMARY OF THE DRAWINGS

In the following, the invention is explained in detail on the basis of a preferred embodiment in connection with the drawings, showing.

DETAILED DESCRIPTION OF THE PREFERRED EMBODIMENTS

Figure 3:
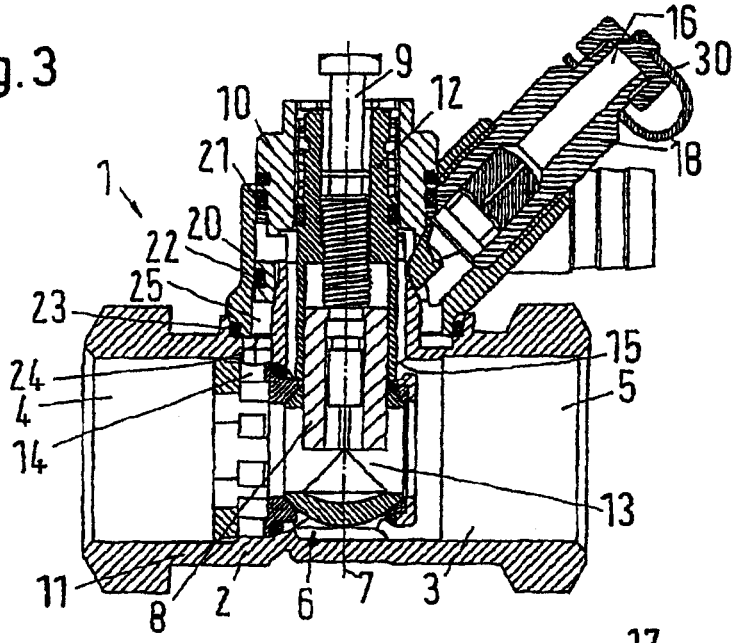
FIG. 3 is a section I-I with partial section III-III according to FIG. 1.
Figure 2:
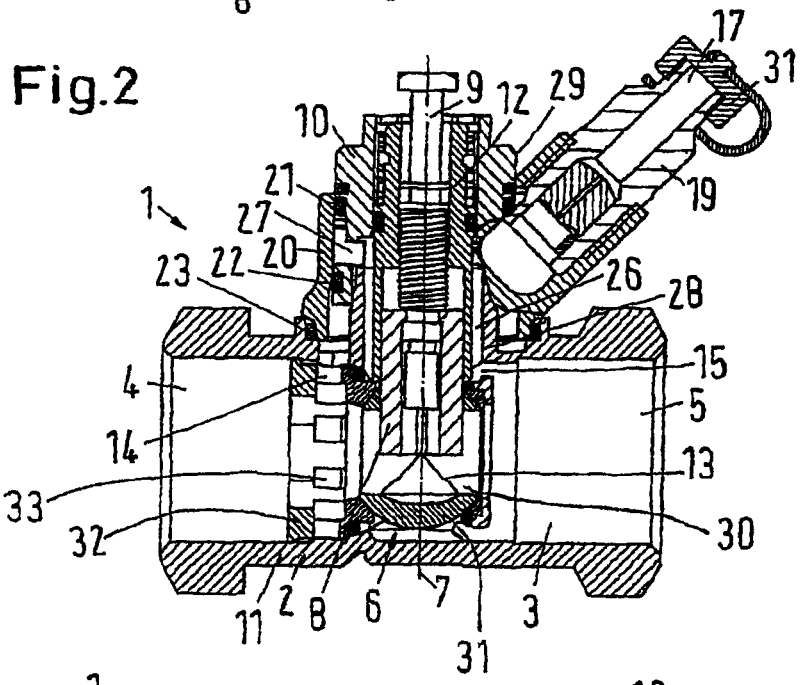
FIG. 2 is a section I-I with partial section II according to FIG. 1.

A flow adjustment valve 1 comprises a valve housing 2, through which a flow channel 3 with an inlet 4 and an outlet 5 extends. The flow direction can also be reversed. Between the inlet 4 and the outlet 5 is arranged a throttle unit 6, which comprises a throttle element 8 that is adjustable along an axis 7. The throttle element 8 is displaceable by means of an adjusting spindle 9, which is, for this purpose, rotatable in a screw thread that is not shown in detail.

The valve housing 2 has a pipe stub 10, which is arranged to be approximately rectangular to a longitudinal section 11, the longitudinal section 11 extending in parallel to the flow channel 3. The primary purpose of the pipe stub 10 is to support the throttle element 8. For this purpose, the throttle element 8 is accommodated in an insert 12 that is inserted into the pipe stub 10. In relation to the pipe stub 10, the insert 12 is sealed so that no fluid from the flow channel 3 can reach the outside.

By means of the throttle element 8, the throttle unit 6 forms a flow cross-section 13, which can be changed to set a desired flow through the flow adjustment valve 1. In order to control this flow, a measuring point 14, 15 is provided on either side of the throttle unit 6. Each measuring point 14, 15 can measure the flow ruling in the flow channel 3 at this point. From the pressure difference, which is then provided by this measurement, and information about the dimension of the flow cross-section 13, the flow can be calculated.

In order to bring the pressure from the two measuring points 14, 15 to the outside, so that they can be detected from the outside, two pressure measuring connections 16, 17 are provided, each being arranged in a measuring pipe stub 18, 19. Both measuring pipe stubs 18, 19 are part of a connecting element in the form of a sleeve 20, which is rotatably supported on the pipe stub 10. Between the sleeve 20 and the pipe stub 10 two sealings 21, 22 are arranged. A further sealing 23 is located between the sleeve 20 and the longitudinal section 11 of the valve housing 2.

The measuring point 14 is connected to an annular channel 25 via an opening 24 in the valve housing 2, which is bordered by the sleeve 20, the valve housing 2 and the pipe stub 10. The pressure measuring connection 16 ends in the annular channel 25, independently of the angle position of the sleeve 20 in relation to the pipe stub 10.

The other measuring point 15 is connected to an annular channel 27, via a channel 26 extending in parallel to the axis 7, the annular channel 27 being connected to the second pressure measuring connection 17. In a manner not shown per se, the pipe stub 10 can, at least in the area of the channel 26, be made in several parts, a first part being fixedly connected to or even made in one piece with the valve housing 2, a second part being inserted in or surrounding the first part.

The channel 26 is formed between the insert 12 and the pipe stub 10. In the present embodiment, the pipe stub 10 is made of several parts, namely a pipe stub part 28, which is part of the valve housing 2 and projects at right angles there from, and a pipe stub part 29, which is connected to the pipe stub part 28 as known per se.

The channel 26 is also an annular channel, which surrounds the insert 12. As the channel 26 is located in side the pipe stub 10, a sealing towards the outside is not required right away. The annular channel 27, however, is sealed by the two sealings 21, 22.

Figure 1:
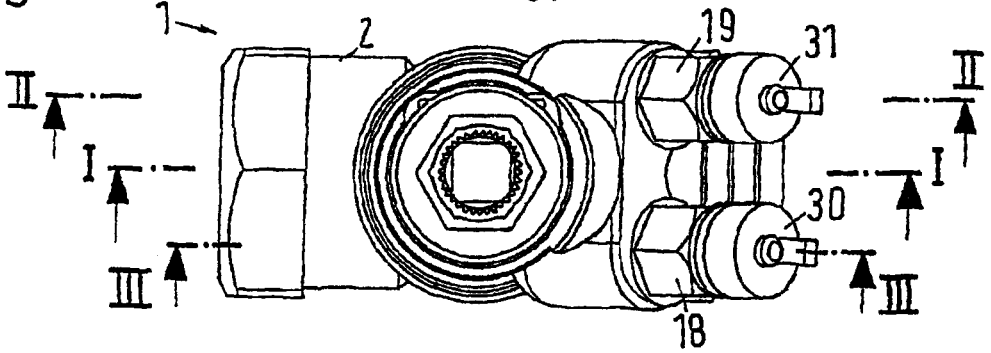
FIG. 1 is a top view of a flow adjustment valve.

As appears from FIG. 1, the two measuring pipe stubs 18, 19 are arranged to be parallel to one another. Accordingly, the two measuring connections 16, 17 are also parallel to one another. They are closed by covers 30, 31. In order to carry through a measuring, the two covers 30, 31 merely have to be removed. Measuring probes, not shown in detail, which are fixed on a common holder, not shown in detail either, can then be inserted in the pressure measuring connections 16, 17 by one movement made by the installer. Thus, only one handling process is required, which significantly simplifies the work of the installer, particularly when the flow adjustment valve is located in inaccessible places.

If the insertion of pressure measuring probes in the pressure measuring connections 16, 17 is not possible in a position, the sleeve 20 can be rotated on the pipe stub 10, to find a more favourable position for the insertion of the measuring probes in the pressure measuring connections 16, 17.

The two measuring pipe stubs 18, 19 approximately half the angle between the pipe stub 10 and the longitudinal section 11 of the valve housing 2. The angle assumed by the measuring pipe stubs 18, 19, however, is not exactly fixed at 45°. It may be somewhere in the range from 20° to 70°. Advantageously, the two measuring pipe stubs 18, 19 are aligned so that they project into the knuckle that is formed between the longitudinal section 11 of the valve housing 2 and the pipe stub 10.

The throttle element 8 projects into a channel 30, which is formed with a ball element 31. The ball element 31 is rotatable around the axis 7, to completely close the flow channel 3.

Thus, the section of the system, through which the flow is adjusted, can also be blocked, for example for maintenance purposes.

The ball element 31 is retained by an annular insert 32, whose circumferential wall comprises openings 33, through which the measuring point 14 is supplied with pressure.

If it is desired to work with a fixed measuring orifice, this orifice can be formed in the annular insert 32. In this case, openings 33 may be provided in the annular insert 32 before and after the measuring orifice. These openings 33 can then be connected to either the measuring point 14 or the measuring point 15.

While the present invention has been illustrated and described with respect to a particular embodiment thereof, it should be appreciated by those of ordinary skill in the art that various modifications to this invention may be made without departing from the spirit and scope of the present invention.

The invention claimed is:

1. A flow adjustment valve having a valve housing comprising a flow channel and a pipe stub arranged at an angle to the flow channel, the pipe stub including a plurality of parts extending axially outward from the valve housing at the angle, a throttle unit being arranged in the flow channel, said throttle unit having a throttle element supported in the pipe stub and being activatable through the pipe stub, and having on each side of a throttle arrangement a measuring point for measuring the pressure in the flow channel, each measuring point being connected to a pressure measuring connection via a first pressure measuring channel or a second pressure measuring channel, wherein at least one pressure measuring channel of the first and second pressure measuring channels is led through the pipe stub and at least a second pressure measuring channel of the first and second pressure measuring channels is led between the pipe stub and a sleeve extending outwardly from the valve housing, the sleeve annularly surrounding at least a portion of the pipe stub, and wherein the pressure measuring connections are rotatably held at the pipe stub such that the pressure measuring connections are rotatable about the pipe stub.

2. The valve according to claim 1, wherein an insert is arranged in the pipe stub, and at least a part of the length of at least one of the pressure measuring channels is formed between the insert and a pipe stub wall.

3. The valve according to claim 2, wherein the insert carries the throttle element.

4. The valve according to claim 1, wherein each pressure measuring connection is placed in a measuring pipe stub, and the measuring pipe stubs extend in parallel to one another.

5. The valve according to claim 4, wherein the measuring pipe stubs enclose an angle in the range of 20° to 70° with the pipe stub.

6. The valve according to claim 4, wherein the measuring pipe stubs are aligned in a knuckle formed between the pipe stub and a longitudinal section of the valve housing surrounding the flow channel.

7. The valve according to claim 1, wherein at least a part of the length of the pipe stub is arranged between the two pressure measuring channels.

8. The valve according to claim 1, wherein the pressure measuring connections are arranged in a connection element that is rotatably held at the pipe stub.

9. The valve according to claim 8, wherein the connection element is the sleeve that surrounds the pipe stub.

10. The valve according to claim 9, wherein an annular channel is formed between the sleeve and the pipe stub.

11. The valve according to claim 9, wherein an annular channel is formed between the sleeve and the valve housing in the area of a front face of the sleeve.

12. The valve according to claim 11, wherein the annular channel is bordered by an outer wall of the sleeve.

13. A flow adjustment valve comprising:

a valve housing having a flow channel formed therein;

a pipe stub extending from the valve housing about an axis;

a throttle arrangement including a throttle unit being arranged in the flow channel, the throttle unit having a throttle element supported in the pipe stub and being activatable through the pipe stub; and a sleeve extending outwardly from the valve housing and annularly surrounding at least a portion of the pipe stub extending about the axis;

wherein a measuring point for measuring a pressure in the flow channel is located on each side of the throttle arrangement, each measuring point being connected to a pressure measuring connection via a first pressure measuring channel or a second pressure measuring channel;

wherein the pressure measuring connections are rotatably held at the pipe stub so that the pressure measuring connections are rotatable about the axis of the pipe stub; and wherein at least the first pressure measuring channel is led through the pipe stub and at least the second pressure measuring channel is formed between the sleeve and the pipe stub.

14. A flow adjustment valve comprising:

a valve housing having a flow channel formed therein;

a pipe stub extending from the valve housing;

a throttle arrangement including a throttle unit being arranged in the flow channel, the throttle unit having a throttle element supported in the pipe stub and being activatable through the pipe stub; and a sleeve extending outwardly from the valve housing and annularly surrounding at least a portion of the pipe stub, the sleeve including at least two pressure measuring connections at which pressure within the flow channel may be detected from outside of the valve housing;

wherein a measuring point for measuring a pressure in the flow channel is located on each side of the throttle arrangement, each measuring point being connected to one of the at least two pressure measuring connection via a pressure measuring channel; and wherein the sleeve is rotatably connected to the pipe stub such that the at least two pressure measuring connections are rotatable about the pipe stub.

* * * * *